US009771534B2

(12) United States Patent
Sprague et al.

(10) Patent No.: US 9,771,534 B2
(45) Date of Patent: Sep. 26, 2017

(54) DIESEL EXHAUST TREATMENT SYSTEMS AND METHODS

(71) Applicant: Clean Diesel Technologies, Inc., Oxnard, CA (US)

(72) Inventors: Barry Sprague, Bethlehem, CT (US); Steve Beal, Bethlehem, CT (US)

(73) Assignee: Clean Diesel Technologies, Inc. (CDTi), Oxnard, CA (US)

( * ) Notice: Subject to any disclaimer, the term of this patent is extended or adjusted under 35 U.S.C. 154(b) by 74 days.

(21) Appl. No.: 13/912,023

(22) Filed: Jun. 6, 2013

(65) Prior Publication Data

US 2014/0360164 A1 Dec. 11, 2014

(51) Int. Cl.

| | |
|---|---|
| ***C10L 1/12*** | (2006.01) |
| ***F01N 3/20*** | (2006.01) |
| ***C10L 10/06*** | (2006.01) |
| ***F01N 3/035*** | (2006.01) |
| ***C10L 1/10*** | (2006.01) |
| ***C10L 1/18*** | (2006.01) |

(Continued)

(52) U.S. Cl.

CPC ..... *C10L 1/1216* (2013.01); *C10L 1/106* (2013.01); *C10L 1/1814* (2013.01); *C10L 10/00* (2013.01); *C10L 10/02* (2013.01); *C10L 10/06* (2013.01); *F01N 3/035* (2013.01); *F01N 3/20* (2013.01); *C10L 2200/024* (2013.01); *C10L 2200/0245* (2013.01); *C10L 2270/026* (2013.01); *C10L 2300/30* (2013.01); *F01N 2430/04* (2013.01)

(58) Field of Classification Search

CPC ..... C10L 1/1216; C10L 10/06; C10L 2200/0245; C10L 2200/024; C10L 1/106; C10L 1/1814; C10L 10/00; C10L 10/02; C10L 2300/30; C10L 2270/026; F01N 3/20; F01N 3/035; F01N 2430/04

See application file for complete search history.

(56) References Cited

U.S. PATENT DOCUMENTS 4,253,436 A * 3/1981 Dudrey ..... F02M 43/00 123/1 A 4,568,357 A 2/1986 Simon (Continued)

FOREIGN PATENT DOCUMENTS

WO WO 90/07561 7/1990

WO WO 94/11467 5/1994

(Continued)

OTHER PUBLICATIONS

International Search Report and Written Opinion for corresponding International Application No. PCT/US2014/041243, dated Sep. 16, 2014.

*Primary Examiner* — Cephia D Toomer

(74) *Attorney, Agent, or Firm* — Alston & Bird LLP

(57) ABSTRACT

Disclosed here are systems and methods including one or more FBCs and one or more suitable aftertreatment devices, including DOCs, DPFs, and suitable combinations thereof. The systems and methods disclosed may include selecting a suitable FBC for use with a fuel with a specified sulfur content. Systems and methods disclosed here may also include using one or more ECUs to control one or more FBC dosing/metering devices to supply FBCs from one or more FBC reservoirs in the presence of a specified event.

17 Claims, 1 Drawing Sheet

(51) Int. Cl.
*C10L 10/00* (2006.01)
*C10L 10/02* (2006.01)

(56) References Cited

U.S. PATENT DOCUMENTS 4,621,593 A * 11/1986 Rao ..... F02B 47/00 123/1 A
4,629,472 A 12/1986 Haney, III et al.
4,891,050 A 1/1990 Bowers et al.
4,892,562 A 1/1990 Bowers et al.
5,034,020 A 7/1991 Epperly et al.
5,168,836 A 12/1992 Kraus
5,203,166 A 4/1993 Miller
5,266,083 A 11/1993 Peter-Hoblyn et al.
5,404,841 A 4/1995 Valentine
5,501,714 A 3/1996 Valentine et al.
5,535,708 A 7/1996 Valentine
5,584,894 A 12/1996 Peter-Hoblyn et al.
5,693,106 A 12/1997 Peter-Hoblyn et al.
5,732,548 A 3/1998 Peter-Hoblyn et al.
5,743,922 A 4/1998 Peter-Hoblyn et al.
5,749,928 A 5/1998 Epperly et al.
5,809,774 A 9/1998 Peter-Hoblyn et al.
5,809,775 A 9/1998 Tarabulski et al.
5,819,529 A 10/1998 Peter-Hoblyn et al.
5,868,421 A 2/1999 Eyrainer
5,921,080 A 7/1999 Ulmet et al.
5,924,280 A 7/1999 Tarabulski
5,939,354 A 8/1999 Golden
5,968,464 A 10/1999 Peter-Hoblyn et al.
5,976,475 A 11/1999 Peter-Hoblyn et al.
5,977,017 A 11/1999 Golden
6,003,303 A 12/1999 Peter-Hoblyn
6,023,928 A 2/2000 Peter-Hoblyn et al.
6,051,040 A * 4/2000 Peter-Hoblyn ..... 44/358
6,063,350 A 5/2000 Tarabulski et al.
6,124,130 A 9/2000 Olson
6,203,770 B1 3/2001 Peter-Hoblyn et al.
6,279,603 B1 8/2001 Czarnik et al.
6,352,955 B1 3/2002 Golden
6,361,754 B1 3/2002 Peter-Hoblyn et al.
6,372,686 B1 4/2002 Golden
6,531,425 B2 3/2003 Golden
6,948,926 B2 * 9/2005 Valentine et al. ..... 431/2
7,014,825 B2 3/2006 Golden
7,216,681 B2 * 5/2007 Valentine ..... B60K 15/04 123/1 A
7,473,288 B2 1/2009 Toyoda et al.
7,527,776 B2 5/2009 Golden et al.
7,641,875 B1 1/2010 Golden
8,323,601 B2 12/2012 Justic et al.
8,802,582 B2 8/2014 Malyala et al.
8,845,987 B1 9/2014 Nazarpoor et al.
8,853,121 B1 10/2014 Nazarpoor et al.
9,216,410 B2 12/2015 Hatfield
2001/0001354 A1 5/2001 Peter-Hoblyn et al.
2002/0001554 A1 1/2002 Czarnik et al.
2002/0042341 A1 4/2002 Golden
2003/0109047 A1 6/2003 Valentine
2003/0126789 A1 7/2003 Valentine et al.
2003/0148235 A1 8/2003 Valentine et al.
2003/0185722 A1 10/2003 Toyoda
2003/0198582 A1 10/2003 Golden
2004/0098905 A1 5/2004 Valentine et al.
2004/0172876 A1 9/2004 Sprague et al.
2005/0132674 A1 6/2005 Toyoda et al.
2005/0160663 A1 7/2005 Valentine
2005/0160724 A1 7/2005 Valentine et al.
2005/0164139 A1 7/2005 Valentine et al.
2005/0188605 A1 9/2005 Valentine et al.
2005/0217751 A1 10/2005 Valentine et al.
2006/0081922 A1 4/2006 Golden
2006/0120936 A1 6/2006 Alive et al.
2006/0166816 A1 7/2006 Zhang et al.
2006/0228283 A1 10/2006 Malyala et al.
2006/0254535 A1 11/2006 Valentine et al.
2006/0260185 A1 11/2006 Valentine et al.
2007/0015656 A1 1/2007 Valentine et al.
2007/0209272 A1 9/2007 Valentine
2007/0283681 A1 12/2007 Makkee et al.
2008/0210184 A1 9/2008 Valentine et al.
2008/0226524 A1 9/2008 Alive et al.
2009/0004083 A1 1/2009 Valentine et al.
2009/0013588 A1 * 1/2009 Zhou et al. ..... 44/358
2009/0304566 A1 12/2009 Golden et al.
2009/0324468 A1 12/2009 Golden et al.
2009/0324469 A1 12/2009 Golden et al.
2010/0240525 A1 9/2010 Golden et al.
2010/0316545 A1 12/2010 Alive et al.
2010/0316547 A1 12/2010 Justice et al.
2011/0239626 A1 10/2011 Makkee et al.
2012/0183447 A1 7/2012 Kwan et al.
2013/0115144 A1 5/2013 Golden et al.
2013/0236380 A1 9/2013 Golden et al.
2014/0271384 A1 9/2014 Nazarpoor et al.
2014/0271387 A1 9/2014 Nazarpoor
2014/0271388 A1 9/2014 Nazarpoor et al.
2014/0271390 A1 9/2014 Nazarpoor
2014/0271391 A1 9/2014 Nazarpoor
2014/0271392 A1 9/2014 Nazarpoor
2014/0271393 A1 9/2014 Nazarpoor
2014/0271425 A1 9/2014 Nazarpoor
2014/0274662 A1 9/2014 Nazarpoor
2014/0274663 A1 9/2014 Nazarpoor
2014/0274674 A1 9/2014 Nazarpoor et al.
2014/0274675 A1 9/2014 Nazarpoor
2014/0274677 A1 9/2014 Nazarpoor
2014/0274678 A1 9/2014 Nazarpoor
2014/0298714 A1 10/2014 Sprague
2014/0301906 A1 10/2014 Hatfield
2014/0301909 A1 10/2014 Nazarpoor
2014/0301926 A1 10/2014 Hatfield
2014/0301931 A1 10/2014 Nazarpoor
2014/0302983 A1 10/2014 Nazarpoor
2014/0334978 A1 11/2014 Hatfield
2014/0334989 A1 11/2014 Nazarpoor et al.
2014/0334990 A1 11/2014 Nazarpoor
2014/0335625 A1 11/2014 Hatfield
2014/0335626 A1 11/2014 Hatfield
2014/0336038 A1 11/2014 Nazarpoor et al.
2014/0336044 A1 11/2014 Nazarpoor et al.
2014/0336045 A1 11/2014 Nazarpoor et al.
2014/0356243 A1 12/2014 Nazarpoor
2014/0357475 A1 12/2014 Nazarpoor et al.
2014/0357479 A1 12/2014 Nazarpoor et al.
2014/0360164 A1 12/2014 Sprague et al.
2014/0364303 A1 12/2014 Hatfield
2015/0004709 A1 1/2015 Nazarpoor
2015/0005157 A1 1/2015 Nazarpoor et al.
2015/0005158 A1 1/2015 Nazarpoor
2015/0005159 A1 1/2015 Nazarpoor et al.
2015/0017082 A1 1/2015 Nazarpoor
2015/0018202 A1 1/2015 Nazarpoor et al.
2015/0018203 A1 1/2015 Nazarpoor et al.
2015/0018204 A1 1/2015 Nazarpoor et al.
2015/0018205 A1 1/2015 Nazarpoor et al.
2015/0031268 A1 1/2015 Waites et al.
2015/0050742 A1 2/2015 Nazarpoor
2015/0051067 A1 2/2015 Nazarpoor et al.
2015/0105242 A1 4/2015 Nazarpoor et al.
2015/0105243 A1 4/2015 Nazarpoor et al.
2015/0105245 A1 4/2015 Nazarpoor et al.
2015/0105246 A1 4/2015 Nazarpoor et al.
2015/0105247 A1 4/2015 Nazarpoor et al.
2015/0147239 A1 5/2015 Launois et al.
2015/0147251 A1 5/2015 Nazarpoor et al.
2015/0148215 A1 5/2015 Nazarpoor
2015/0148216 A1 5/2015 Nazarpoor et al.
2015/0148220 A1 5/2015 Nazarpoor
2015/0148222 A1 5/2015 Nazarpoor
2015/0148223 A1 5/2015 Nazarpoor et al.
2015/0148224 A1 5/2015 Nazarpoor et al.
2015/0148225 A1 5/2015 Nazarpoor et al.
2015/0182951 A1 7/2015 Nazarpoor et al.

(56) References Cited

U.S. PATENT DOCUMENTS

| | | | |
|---|---|---|---|
| 2015/0182954 | A1 | 7/2015 | Nazarpoor et al. |
| 2015/0196902 | A1 | 7/2015 | Golden et al. |
| 2015/0238940 | A1 | 8/2015 | Nazarpoor et al. |
| 2015/0238941 | A1 | 8/2015 | Nazarpoor et al. |
| 2015/0258496 | A1 | 9/2015 | Hatfield et al. |
| 2015/0290627 | A1 | 10/2015 | Nazarpoor et al. |
| 2015/0290630 | A1 | 10/2015 | Nazarpoor et al. |
| 2015/0316524 | A1 | 11/2015 | Hatfield |
| 2015/0352494 | A1 | 12/2015 | Hatfield et al. |
| 2015/0352529 | A1 | 12/2015 | Nazarpoor et al. |
| 2015/0352531 | A1 | 12/2015 | Hatfield et al. |
| 2015/0352532 | A1 | 12/2015 | Hatfield et al. |
| 2015/0352533 | A1 | 12/2015 | Hatfield et al. |
| 2016/0023188 | A1 | 1/2016 | Nazarpoor et al. |
| 2016/0030885 | A1 | 2/2016 | Hatfield |
| 2016/0047751 | A1 | 2/2016 | Pless et al. |
| 2016/0082422 | A1 | 3/2016 | Nazarpoor et al. |
| 2016/0121304 | A1 | 5/2016 | Nazarpoor et al. |
| 2016/0121308 | A1 | 5/2016 | Nazarpoor et al. |
| 2016/0121309 | A1 | 5/2016 | Nazarpoor et al. |
| 2016/0136617 | A1 | 5/2016 | Nazarpoor et al. |
| 2016/0136618 | A1 | 5/2016 | Nazarpoor et al. |
| 2016/0136619 | A1 | 5/2016 | Nazarpoor et al. |
| 2016/0136620 | A1 | 5/2016 | Nazarpoor et al. |
| 2016/0136621 | A1 | 5/2016 | Nazarpoor et al. |
| 2016/0167023 | A1 | 6/2016 | Nazarpoor et al. |
| 2016/0167024 | A1 | 6/2016 | Nazarpoor et al. |

FOREIGN PATENT DOCUMENTS

| | | | |
|---|---|---|---|
| WO | WO 95/02655 | | 1/1995 |
| WO | WO 97/04045 | | 2/1997 |
| WO | WO 97/09523 | | 3/1997 |
| WO | WO 97/28358 | | 8/1997 |
| WO | WO 97/36676 | | 10/1997 |
| WO | WO 98/22209 | A1 | 5/1998 |
| WO | WO 98/28070 | A1 | 7/1998 |
| WO | WO 00/30739 | A1 | 6/2000 |
| WO | WO 00/75643 | A1 | 12/2000 |
| WO | WO 01/085876 | A1 | 11/2001 |
| WO | WO 03/068363 | A1 | 8/2003 |
| WO | WO 2004/058641 | A1 | 7/2004 |
| WO | WO 2009/139860 | A1 | 11/2009 |
| WO | WO 2011/068509 | A1 | 6/2011 |
| WO | WO 2014/194101 | A1 | 12/2014 |
| WO | WO 2015/199687 | A1 | 12/2015 |
| WO | WO 2015/199688 | A1 | 12/2015 |
| WO | WO 2016/039747 | A1 | 3/2016 |

* cited by examiner

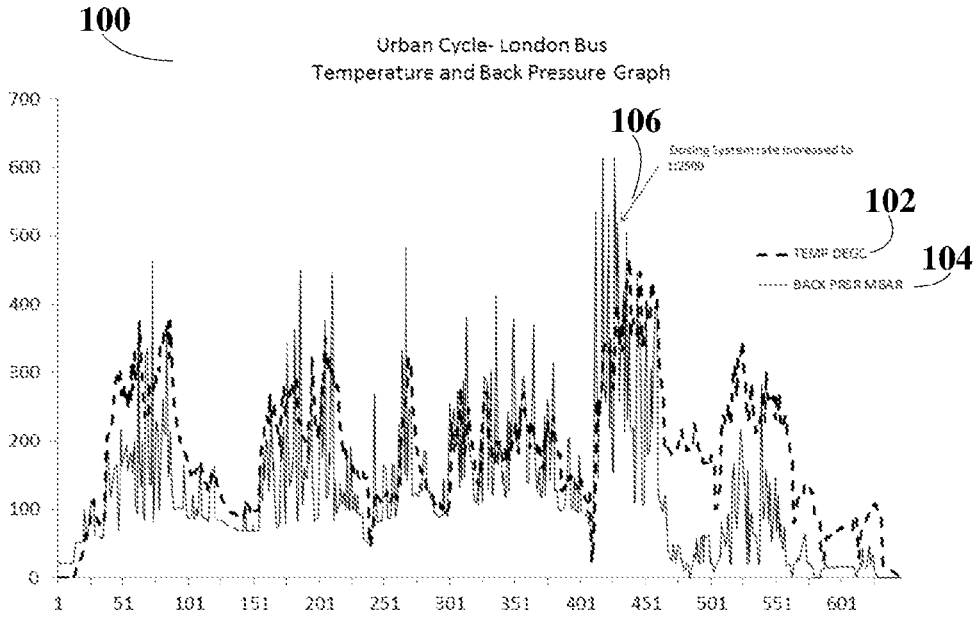
100
Urban Cycle- London Bus
Temperature and Back Pressure Graph
106
102
104
TEMP DEGC
BACK PRSR MBAR
700
600
500
400
300
200
100
0
1
51
101
151
201
251
301
351
401
451
501
551
601

DIESEL EXHAUST TREATMENT SYSTEMS AND METHODS

CROSS-REFERENCE TO RELATED APPLICATIONS

N/A

BACKGROUND

Field of the Disclosure

The present disclosure relates in general to diesel catalyst systems, and more specifically to exhaust treatment systems employing Fuel Borne Catalysts and Aftertreatment Devices.

Background Information

Diesel engines are highly regarded for their efficiency and reliability. However, they may produce a level of pollution higher than that desired, and may need to have after-treatment strategies, including one or more of either a catalyzed Diesel Particulate Filter (DPF) or Diesel Oxidation Catalyst (DOC)—to control Particulate Matter (PM), Hydrocarbon (HC), and Carbon Monoxide (CO) emissions. Materials of use in DPFs and DOCs may include Platinum Group Metal (PGM) Catalysts as well as Zero Platinum Group Metal (ZPGM) catalysts, where the latter may provide suitable performance at a price lower than that of comparable PGM Catalysts.

Strategies for exhaust treatments may also include suitable Fuel Borne Catalysts (FBCs), where the materials of use in these FBCs may include suitable PGMs and non-PGM. However, there are many possible strategies that may employ one or more FBCs and one or more suitbale DPFs/DOCs, many of which may remain unknown in the art.

As such, there is a continuing need for developing suitable exhaust treatment strategies employing ZPGM catalysts and FBCs, where the treatment conditions may vary in one or more factors, including fuel sulfur content.

SUMMARY

Disclosed here are systems and methods for the treatment of exhaust gases including at least one Fuel Borne Catalyst (FBC) with one or more of a Diesel Oxidation Catalyst (DOC), a Diesel Particulate Filter (DPF), or any suitable combination.

Suitable FBCs, DOCs, and DPFs may be selected according to the Sulfur Content in the fuel, where suitable FBCS may include one or more of any suitable Platinum Group Metals (PGMs), Transition Metals, Post-transition Metals, Alkali metals, Alkaline Earth Metals, and Rare Earth Metals, including Platinum, Palladium, Iron, Manganese, Cerium, Yttrium, Lithium, Sodium, Calcium, Strontium, Vanadium, Silver, Chromium, Gallium, Cobalt, Nickel, Copper, Niobium, Molybdenum, and Tungsten, where suitable FBCs may include a total metal content at or below 15 ppm. Suitable DOCs, DPFs, and combinations may include one or more suitable Zero Palladium Group Metal (ZPGM) catalysts.

Systems using suitable FBCs and a suitable DOC, DPF, or combination thereof, may also include one or more suitable FBC Reservoirs and may include one or more suitable FBC metering/dosing devices. Suitable systems may also include one or more Engine Control Units (ECUs), where FBC metering/dosing devices may be controlled by one or more of the ECUs. Suitable ECU's of use in suitable systems may use any suitable algorithm to increase or decrease the dosing of one or more suitable FBCs in the presence of one or more suitable events, where suitable events may include the presence of specified temperature or backpressure profiles.

Numerous other aspects, features and benefits of the present disclosure may be made apparent from the following detailed description taken together with the drawing figures.

BRIEF DESCRIPTION OF THE DRAWINGS

The present disclosure can be better understood by referring to the following figures. The components in the figures are not necessarily to scale, emphasis instead being placed upon illustrating the principles of the disclosure. In the figures, reference numerals designate corresponding parts throughout the different views.

FIG. 1 shows a Temperature/Backpressure Graph for a London Bus in an Urban Cycle.

DETAILED DESCRIPTION

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here.

DEFINITIONS

As used here, the following terms may have the following definitions:

"Fuel Borne Catalyst (FBC)" refers to any material suitable for use as a catalyst able to be stored in fuel as one or more of a solute, colloid, or otherwise suspended material.

"Conversion" refers to the chemical alteration of at least one material into one or more other materials.

"Catalyst" refers to one or more materials that may be of use in the conversion of one or more other materials.

"High Sulfur Fuel" refers to fuel with a sulfur content of about 100 ppm or greater.

"Low Sulfur Fuel" refers to fuel with a sulfur content of about 50 ppm or fewer.

"Platinum Group Metals (PGMs)" refers to platinum, palladium, ruthenium, iridium, osmium, and rhodium.

"Carrier material oxide" refers to support materials used for providing a surface for at least one catalyst.

"Oxygen Storage Material (OSM)" refers to a material able to take up oxygen from oxygen rich streams and able to release oxygen to oxygen deficient streams.

DESCRIPTION OF DRAWINGS

The present disclosure describes systems and methods including one or more FBCs and one or more suitable aftertreatment devices, including DOCs, DPFs, and suitable combinations thereof.

Fuel Borne Catalysts

Fuel Borne Catalysts of use in diesel combustion systems may include one or more of any suitable platinum group metal, including Pt or Pd, any suitable transition metal, including Fe, V, Ag, or Mn, any suitable rare earth metal, including Ce or Y, any suitable Alkali metal, including Li and Na, any suitable alkaline earth metal, including Ca and St, or any suitable combination.

High Sulfur Fuel Formulations

FBC formulations of use with high sulfur fuel includes formulations containing one or more of the following and combinations thereof:

- A platinum group metal—including Pt or Pd—at 0.01 to 0.5 ppm in the fuel
- A transition metal—including Fe or Mn—at 1-10 ppm in the fuel
- A rare earth metal—including Ce or Y—at 1-10 ppm in the fuel Additional materials of use in the fuel include:

- Li or Na at 0-3 ppm, which may be of use in activating the PGM catalyst
- Ca or Sr at 0-3 ppm, which may act as a sulfate sink
- V at 0-3 ppm, which may modify SO3 formation
- Ag at 0-3 ppm where suitable total FBC metal contents include suitable values in a range not exceeding about 15 ppm.

Low Sulfur Fuel Formulations

FBC formulations of use with low sulfur fuel includes formulations containing one or more of the following and combinations thereof:

- Cerium and Iron—at 1-10 ppm of each in the fuel
- Y, Ag, Mn—at 0-3 ppm in the fuel
- A platinum group metal—including Pt or Pd—at 0 to 0.01 ppm in the fuel Additional materials of use in the fuel include:

- Suitable transition and post-transition metals, including Cr, Ga, Mn, Fe, Co, Ni, Cu, Nb, Mo, and W—at at 0-1 ppm in the fuel where suitable total FBC metal contents include suitable values in a range not exceeding about 15 ppm.

FBC Materials

Metals suitable for use in FBCs may be in stable fuel soluble forms, including any suitable carboxylates, acetylacetaonates and cyclopentadienyl complexes. Suitable metals may also be present as particles of a size suitable to form a colloidal suspension or other suitable suspension.

Some suitable Platinum and Palladium compounds of use in FBCs are described in U.S. Pat. No. 4,892,562, U.S. Pat. No. 5,034,020 and U.S. Pat. No. 6,003,303. Suitable compounds include soaps, B-diketonates and alkyl and arylalkyl metal complexes. These compounds may be fuel soluble and fuel stable at very low dose rates—i.e., below 0.5 ppm metal and as discussed in the cited patents.

Transition metals of use in FBC applications include iron and manganese, where these may be used as a major constituent of the FBC catalyst metals, where the FBC may include one or more rare earth metals as described above. Transition metals and post transition metals may be present as long chain carboxylates any suitable various forms, including carboxylates, $M(OOCR)_n$; oxycarboxylates, $MO_x(OOCR)_y$ and dimeric oxycarboxylates $(MO)_2(OOCR)_y$; where R may be alkyl, arylalkyl, aryl and cycloalkyl, there may be at least 10 total carbon atoms present in the molecule, and n, x and y are integers. These metals can also be used in the form of acetylacetonates and cyclopentadienyl derivatives.

Rare earths metalas, including as cerium and yttrium, may also be of use in the form of carboxylates M(OOCR)n, or cluster nanoparticulate oxy or hydroxyl carboxylates, e.g., $M_z(OH)_x(OOCR)_y$, where R is any suitable hydrocarbon with at least 10 carbon atoms and includes previously listed hydrocarbon structures. Other forms of use may include fuel soluble, non halogen containing acetylacetonates and cyclopentadienyl derivatives.

Silver may be incorporated as any suitable fuel soluble carboxylate, including long chain alkyl soaps with 5-20 carbon atoms and substituted benzoate salts with at least 10 carbon atoms, including a benzene ring, an acetylacetonate, or derivatives.

Diesel Oxidation Catalyst/Diesel Particulate Filter Materials

Materials suitable for use in DOCs and DPFs may include ZPGM catalysts. Suitable ZPGM catalysts may include mixed phase catalysts including any suitable metal oxide phase, where suitable metals may include any suitable transition metal, post-transition metal, rare-earth metal, and any suitable combination thereof. The catalysts may be synthesized by any suitable method, including co-precipitation, co-milling, the sol-gel method, templating, and may include any suitable Carrier Material Oxide as well as any suitable Oxygen Storage Material.

DOCs of use with High Sulfur Fuels may have surfaces coated with an active PGM layer, which may be prevented from catalyzing the formation of a significant concentration of SO3 while maintaining a suitable catalytic activity.

DOCs of use with High Sulfur Fuels may include a thin (~10 um), inert, sulfur resistant protective layer washcoat that may allow some contact with the gas so that oxidation may occur, where the oxidation may not include an excessive adsorption of SO2 and promotion of oxidation of SO2. Materials suitable for use in this layer include SiO2, TiO2 and ZrO2, and may be applied by any suitable washcoating technique known to those skilled in the art. These washcoats may contain various ZPGM catalyst components—including Ce, Fe and the like. These washcoats may become further activated further by adsorption of any PGM from suitable FBCs in use, including Pt, Pd, or any suitable combination.

Suitable ZPGM catalysts of use in DOCs and DPFs that may of use in embodiments with High Sulfur Fuel include V2O5 or AgVO3, where these may be applied as part of a surface coating or as a separate SO3 removal catalyst bed downstream of the active catalyst leading edge. This may cause SO3 formed upstream of the bed to be converted to SO2.

Suitable PGMs catalysts of use in DOCs and DPFs that may of use in embodiments with High Sulfur Fuel include catalysts using Pd and Pt, where catalysts including Pd may be used as a surface coating and catalysts including Pt and other PGMs may be applied in nano-particulate form, where the particle sizes may be below 40 nm.

Exhaust Treatment Systems

Exhaust treatments systems disclosed herein may include one or more FBCs suitable for use in conjunction with any suitable DOC, any suitable DPF, or any suitable DOC and DPF combination, where suitable DOC and DPF combinations may include one or more ZPGM Catalysts.

Metals suitable for use in the FBCs may be selected based on catalytic components found in the catalysts used in the DOC, DPF, or suitable DOC/DPF combination, where the catalysts used may benefit from replenishment at very low levels. The catalytic acitivy of the FBC activated soot may increase due to the contact of the FBC catalysts with the bulk of the PM. Metallic oxide particles present in stationary devices, including DOCs and DPFs, as well as particles supplied by the combustion of the FBC, may be very active, stable nano-particulate forms and may complement each other in use.

The suitable combination of at least one FBC with at least one DOC or DPF may be selected according to the sulfur content in the fuel.

In embodiments of use with High Sulfur Fuels, materials selected for use in suitable DOCs and DPFs may be resistant to attacks by sulfur compounds, and FBCs of use with High Sulfur Fuels may be selected to be resistant to SO2/SO3 and actively catalyze soot in the presence of SO2 at high concentrations. FBCs of use may also include materials selected to improve the performance of catalysts of use in suitable DOCs and DPFs, or otherwise replenish or reactivate the catalytic materials used in the devices.

Exhaust treatment systems including one or more FBCs suitable for use in conjunction with any suitable DOC, any suitable DPF, or any suitable DOC and DPF combination, may include any number of suitable FBC reservoirs with one or more suitable metering or dosing pumps. The systems may also include an engine control system which may control the dosing or metering pump, which may use one or more of back-pressure, temperature, or any other suitable input across the device to regulate the FBC addition to the fuel.

FBC addition to the fuel may be controlled by a suitable Engine Control Unit (ECU), where the ECU may inject FBC based of fuel volume, where suitable methods may include either tank measurements, including measurements before and after fill up, or fuel flow measurements, including in the fuel line or as the fuel is added to the tank. These methods may be based on standard volumetric basis, where a suitable volume of FBC may be added to a suitable volume of fuel resulting in the desired ppm concentration.

Suitable FBCs may reduce the ignition temp of the soot to about 350-400 C, which may allow normal duty cycles to effect a passive regeneration when combined with catalyzed devices suitable circumstances.

In some embodiments, an FBC reservoir may include an independent dosing or metering pump which may be controlled by a suitable ECU to inject the FBC when the ECU may detect a suitable event. Suitable events may include the presence of unsatisfactory back pressure profiles, where the FBC is then injected to cause the back pressure profile to approach the desired profile. In other embodiments, the FBC dosing rate may be increased in the presence of the event. Once the event may end, the ECU may stop the operation of the independent dosing or metering pump or may return the operation of the main dosing or metering pumps to normal dosing levels. In some embodiments, the FBC used in this mechanism may differ from the FBC used in the main system, and may include suitable amounts of suitable PGMs, including FBCs containing 0-0.5 ppm of PGMs.

FIG. 1 shows Backpressure/Temperature Chart 100 for a London Bus in an urban cycle. in Backpressure/Temperature Chart 100, when Temperature Profile 102 and Back Pressure Profile 104 reach a predetermined level in Event 106, the dosing system may increase the concentration of FBC in the fuel. Once FBC dosing is increased in Event 106, Temperature Profile 102 and Back Pressure Profile 104 may approach the desired profiles.

In some embodiments, events similar to Event 106 may occur periodically after given periods of time, ranging from hours to days of operation.

What is claimed is:

1. A method for improving operation of a diesel engine by lowering emissions of unburned hydrocarbons and carbon monoxide, the method comprising the steps of:

providing for at least one fuel borne catalyst reservoir containing a fuel borne catalyst;

providing for a presence of a diesel fuel and combustion air;

providing for an engine control unit is configured to inject the fuel borne catalyst from the at least one fuel borne catalyst reservoir into the diesel fuel;

providing for combusting of the diesel fuel in the diesel engine to produce exhaust gases; and, providing for directing of the exhaust gases into an exhaust system;

wherein the fuel borne catalyst comprises:

a platinum group metal composition comprising at least one material selected from the group consisting of platinum, and palladium, and mixtures thereof;

at least one rare earth metal selected from the group consisting of cerium, yttrium, and mixtures thereof; and at least one transition metal compound comprising at least one carboxylate having a general formula selected from the group consisting of M(OOCR)n, MOx(OOCR)y, (MO)2(OOCR)y, and combinations thereof, wherein M is a transition metal, wherein R is selected from the group consisting of an alkyl, an arylalkyl, aryl, and cycloalkyl, and n, x, and y are integers;

wherein the exhaust system comprises at least one of the group consisting of a diesel oxidation catalyst system and a diesel particulate filter;

wherein the engine control unit in a first state is configured to inject the fuel borne catalyst from the at least one fuel borne catalyst reservoir to the diesel fuel so that a fuel borne catalyst metal content in the diesel fuel is about 2 ppm to about 15 ppm; and wherein the engine control unit is configured in a second state to inject an additional amount of the fuel borne catalyst from the at least one fuel borne catalyst reservoir into the diesel fuel in response to an event, wherein said event is selected from the group consisting of an unsatisfactory back-pressure profile of one or more of the diesel oxidation catalyst system or the diesel particulate filter;

a back-pressure of the diesel oxidation catalyst system or the diesel particulate filter being above a first threshold back-pressure;

a temperature of the exhaust gases being below a threshold temperature;

a temperature of the exhaust gases being above a threshold temperature;

a back-pressure of the at least one of the group consisting of the diesel oxidation catalyst system and the diesel particulate filter is above a first threshold back-pressure;

an input value exceeds a threshold input value, wherein the input value is a back pressure of one or more of the diesel oxidation catalyst system or the diesel particulate filter, or a temperature of the exhaust gases; and an input value is below a threshold input value, wherein the input value is a back pressure of one or more of the diesel oxidation catalyst system or the diesel particulate filter, or a temperature of the exhaust gases.

2. The method of claim 1 wherein the engine control unit is configured to return to the first state when the event ceases.

3. The method of claim 2 wherein the event is an unsatisfactory back-pressure profile of the at least one of the group consisting of the diesel oxidation catalyst system and the diesel particulate filter.

4. The method of claim 2 wherein the event is when a back-pressure of the at least one of the group consisting of the diesel oxidation catalyst system and the diesel particulate filter is above a first threshold back-pressure.

5. The method of claim 2 wherein the event is when a temperature of the exhaust gases are below a threshold temperature.

6. The method of claim 2 wherein the event is when a temperature of the exhaust gases are above a threshold temperature.

7. The method of claim 1 wherein the event is when a back-pressure of the at least one of the group consisting of the diesel oxidation catalyst system and the diesel particulate filter is above a first threshold back-pressure.

8. The method of claim 1 wherein the event is when an input value exceeds a threshold input value;

wherein the input value is at least one of a group consisting of a back-pressure and a temperature wherein the engine control unit is configured to return to the first state when the input value falls below the threshold input value.

9. The method of claim 1 wherein the event is when an input value is below a threshold input value;

wherein the input value is at least one of a group consisting of a back-pressure and a temperature wherein the engine control unit is configured to return to the first state when the input value exceeds the threshold input value.

10. The method of claim 8 wherein the engine control unit is configured to return to the first state when the back-pressure of the at least one of the group consisting of the diesel oxidation catalyst system and the diesel particulate filter is below the first threshold back-pressure.

11. The method of claim 8 wherein the engine control unit is configured to return to the first state when the back-pressure of the at least one of the group consisting of the diesel oxidation catalyst system and the diesel particulate filter is below a second threshold back-pressure.

12. The method of claim 1, wherein M is selected form the group consisting of iron, manganese, and combinations thereof.

13. The method of claim 1, wherein the engine control unit in the first state is configured to inject the fuel borne catalyst from the at least one fuel borne catalyst reservoir to the diesel fuel so that M comprises about 1 ppm to about 10 ppm of the diesel fuel.

14. The method of claim 1, wherein the engine control unit in the first state is configured to inject the fuel borne catalyst from the at least one fuel borne catalyst reservoir to the diesel fuel so that the at least one rare earth metal comprises about 1 ppm to about 10 ppm of the diesel fuel.

15. The method of claim 1, wherein the engine control unit in the first state is configured to inject the fuel borne catalyst from the at least one fuel borne catalyst reservoir to the diesel fuel so that a platinum group metal comprises about 0.01 ppm to about 0.5 ppm of the diesel fuel.

16. The method of claim 1, wherein M is selected form the group consisting of chromium, gallium, cobalt, nickel, copper, niobium, molybdenum, tungsten, and combinations thereof.

17. The method of claim 1, wherein ignition temperature of soot resulting from the combusting of the diesel fuel is about 350° C. to about 400° C.

* * * * *